US010170816B2

(12) United States Patent
Nita et al.

(10) Patent No.: US 10,170,816 B2
(45) Date of Patent: Jan. 1, 2019

(54) HIGH FREQUENCY FILTER HAVING A COAXIAL STRUCTURE

(71) Applicant: Kathrein-Werke KG, Rosenheim (DE)

(72) Inventors: Jens Nita, Rosenheim (DE); Franz Rottmoser, Schechen (DE)

(73) Assignee: Kathrein SE, Rosenheim (DE)

( * ) Notice: Subject to any disclaimer, the term of this patent is extended or adjusted under 35 U.S.C. 154(b) by 169 days.

(21) Appl. No.: 15/101,774

(22) PCT Filed: Nov. 6, 2014

(86) PCT No.: PCT/EP2014/002975
§ 371 (c)(1),
(2) Date: Jun. 3, 2016

(87) PCT Pub. No.: WO2015/082033
PCT Pub. Date: Jun. 11, 2015

(65) Prior Publication Data

US 2017/0005389 A1 Jan. 5, 2017

(30) Foreign Application Priority Data

Dec. 5, 2013 (DE) ..... 10 2013 020 428

(51) Int. Cl.
*H01P 1/208* (2006.01)
*H01P 1/207* (2006.01)
(Continued)

(52) U.S. Cl.
CPC ..... *H01P 1/207* (2013.01); *H01P 1/2053* (2013.01); *H01P 5/04* (2013.01)

(58) Field of Classification Search
CPC ..... H01P 1/207; H01P 1/208; H01P 1/2133; H01P 1/2053; H01P 1/2056; H01P 1/205
(Continued)

(56) References Cited

U.S. PATENT DOCUMENTS 3,617,799 A * 11/1971 Schmidt ..... H01J 23/213 315/5.39
3,899,759 A 8/1975 Hines et al.
(Continued)

FOREIGN PATENT DOCUMENTS

CN 1717838 A 1/2006
CN 101378142 A 3/2009
(Continued)

OTHER PUBLICATIONS

Machine translation of JP2004-200892, Jul. 2004.*
(Continued)

*Primary Examiner* — Stephen E. Jones
(74) *Attorney, Agent, or Firm* — Nixon & Vanderhye P.C.

(57) ABSTRACT

An improved high-frequency filter has an adjustment or sliding device for adjusting the coupler bandwidth. The adjustment or sliding device is attached to at least one coupling element. The coupling element is associated with a coupler opening relating to a resonator. The coupling element is related to an associated coupler opening arranged in the resonator such that a means of adjustment and thus the coupling element is adjustable between two extreme settings through adjustment of the adjustment or sliding device in which the coupling element is fully or partially slid into the coupler opening or fully or partially slid out of the coupler opening or is moved or positioned away from the coupler opening.

20 Claims, 11 Drawing Sheets

Figure 1A:
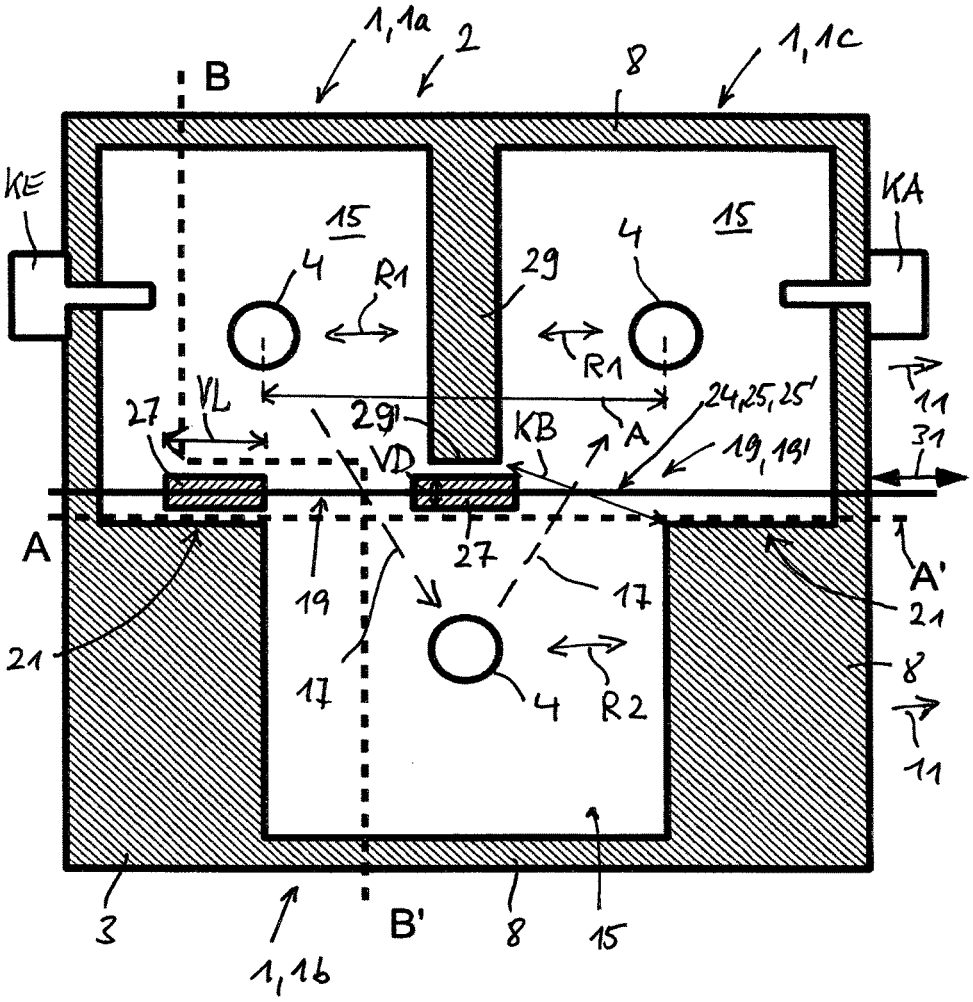

(51) Int. Cl.
*H01P 1/205* (2006.01)
*H01P 5/04* (2006.01)

(58) Field of Classification Search
USPC ..... 333/203, 202, 206, 207
See application file for complete search history.

(56) References Cited

U.S. PATENT DOCUMENTS

| | | |
|---|---|---|
| 5,608,363 A | 3/1997 | Cameron et al. |
| 2005/0040916 A1 | 2/2005 | Park et al. |

FOREIGN PATENT DOCUMENTS

| | | |
|---|---|---|
| DE | 1 222 600 | 2/1967 |
| DE | 2 108 675 | 9/1971 |
| DE | 199 16 605 | 1/2001 |
| DE | 10 2004 055 707 | 4/2006 |
| EP | 0 441 590 | 8/1991 |
| EP | 1 620 913 | 12/2006 |
| EP | 1 732 158 | 12/2006 |
| EP | 2 053 687 | 4/2009 |
| EP | 2 044 648 | 10/2009 |
| EP | 2 453 518 | 5/2012 |
| EP | 1 604 425 | 6/2012 |
| EP | 2 544 297 | 1/2013 |
| JP | 2004-200892 | 7/2004 |
| WO | WO 2009/056813 | 5/2009 |

OTHER PUBLICATIONS

English translation of the International Preliminary Report on Patentability dated Mar. 7, 2016, issued in International Application No. PCT/EP2014/002975.

International Search Report for PCT/EP2014/002975 dated Jan. 21, 2015, 3 pages.

Written Opinion of the ISA (foreign-language) for PCT/EP2014/002975 dated Jan. 21, 2015, 7 pages.

International Preliminary Report on Patentability (foreign-language) for PCT/EP2014/002975 dated Mar. 7, 2016, 45 pages.

Hunter, I.C., Theory and design of microwave filters—(IEE electromagnetic waves series; No. 48), 1. Microwave filters, 2001, 2 pages.

K.V. Puglia, A General Design Procedure for Bandpass Filters Derived from Low Pass Prototype Elements: Part II, Microwave Journal, Jan. 2001, 2 pages.

English translation of Search Report dated Apr. 3, 2018, issued in Chinese Patent Application No. 201480066409.1.

* cited by examiner

Fig. 1b
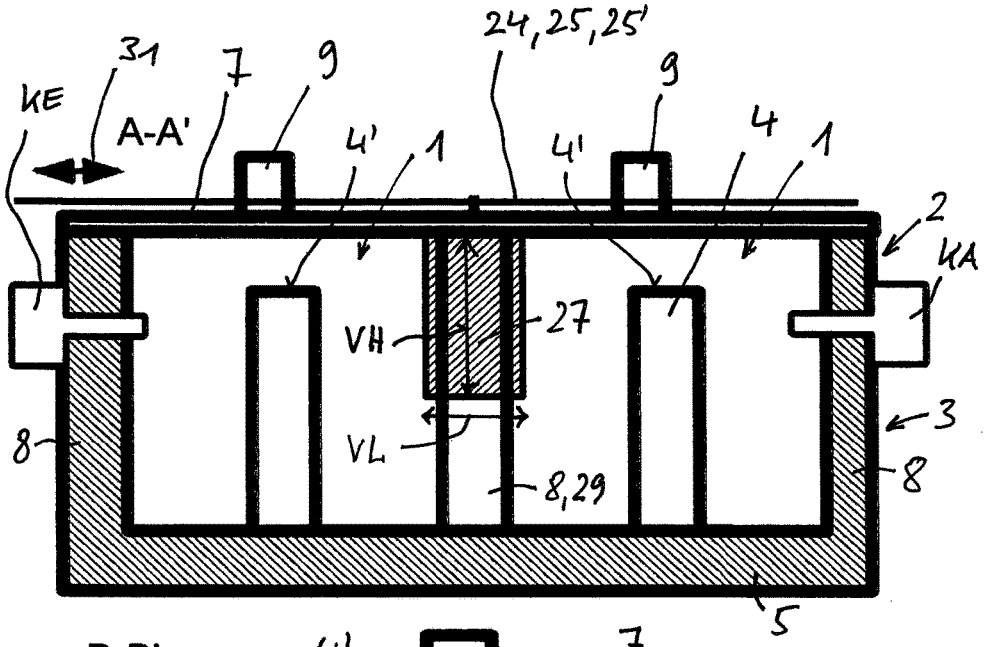
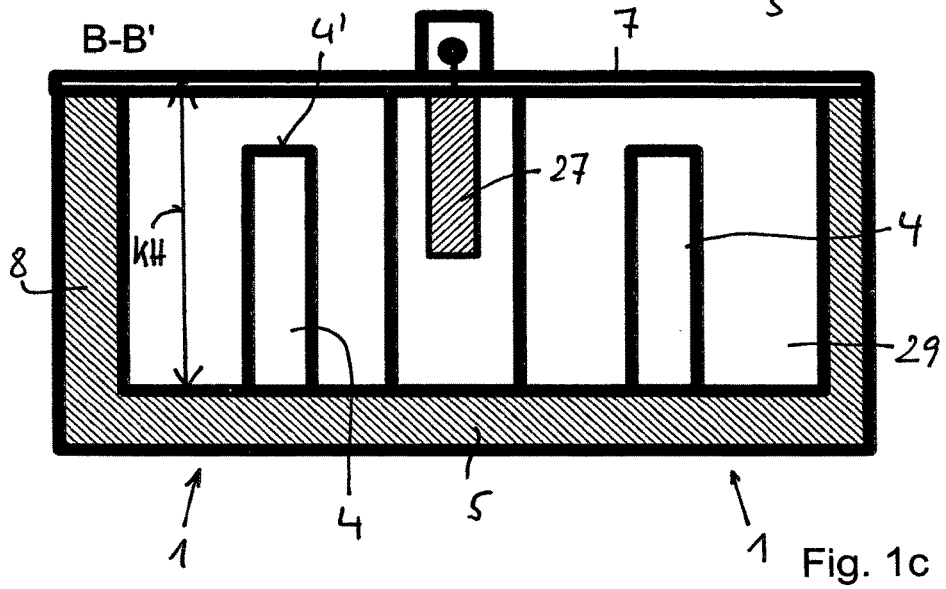
Fig. 1c

HIGH FREQUENCY FILTER HAVING A COAXIAL STRUCTURE

This application is the U.S. national phase of International Application No. PCT/EP2014/002975 filed 6 Nov. 2014 which designated the U.S. and claims priority to DE Patent Application No. 10 2013 020 428.3 filed 5 Dec. 2013, the entire contents of each of which are hereby incorporated by reference.

The invention concerns a high-frequency filter with a co-axial design, in the nature of a high-frequency switch (such as a duplex switch, for example) or a bandpass filter or notch filter.

In radio installations, in the mobile telephony sector for example, the same antenna is often used for transmitter and receiver signals. In doing so, the transmitter and receiver signals each use different frequency ranges, and the antenna must be suitable for transmitting and receiving in both frequency ranges. A suitable frequency filter is therefore required in order to separate the transmitter and receiver signals, with the transmitter signals being forwarded from the transmitter to the antenna on the one hand and the receiver signals being forwarded from the antenna to the receiver on the other. Today, high-frequency filters with a coaxial design, among others, are used for separation of the transmitter and receiver signals.

For example, a pair of high-frequency filters which each let a specific frequency band through (bandpass filters) can be used. Alternatively, a pair of high-frequency filters which each block a specific frequency band (notch filters) can be used. Moreover, a pair of high-frequency filters of which one filter lets frequencies below a frequency between the transmitting and receiving bands through and blocks frequencies above this frequency (low-pass filter) and the other filter blocks frequencies below a frequency between the transmitting and receiving bands and lets frequencies above this through (high-pass filter) can be used. Other combinations of the filter types listed above are also possible. High-frequency filters are often produced in the form of coaxial TEM resonators. These resonators can be produced cost-effectively and efficiently from milled and cast parts and they ensure good electrical quality as well as relatively high temperature stability.

According to the prior publication "Hunter I. C. (Ian C.) Theory and design of microwave filters.—(IEE electromagnetic waves series; no. 48) 1. Microwave filters, ISBN 0 85296 777 2, section 5.8" coaxial resonator filters with a multitude of connected individual resonators are well-known.

According to the publication "A General Design Procedure for Bandpass Filters Derived from Low Pass Prototype Elements: Part II", K. V. Puglia, Microwave Journal, January 2001, pages 114 ff, high-frequency filters which comprise an outer conductor housing in which multiple coaxial cavities are formed in which an inner conductor in the form of an inner conductor conduit is arranged are known. A multitude of resonators arranged in parallel are thereby formed, wherein neighbouring resonators are electrically coupled with one another via coupler openings. The outer conductor housing for this type of high-frequency filter is today usually made using casting or milling technology, whereby the desired response from the filter can be generated through the appropriate choice or size and shape of the coupler openings as well as the distance between neighbouring resonators.

A coaxial individual resonator using milling or casting technology consists, for example, of a cylindrical or rectangular inner conductor and a cylindrical or rectangular outer conductor. The inner and outer conductors are connected via a large area at one end (generally the underside or bottom side) via an electroconductive layer (generally short-circuited through an electroconductive base). There is usually air between the inner and outer conductors as dielectric.

If, as mentioned, the end of the resonator is short-circuited in this fashion, then the mechanical length of the resonator (with air as dielectric) corresponds to a quarter of the electronic wavelength. The resonance frequency of the coaxial resonator is determined by its mechanical length. The longer the inner conductor, the larger the wavelength and therefore the lower the resonance frequency. The weaker the electrical coupling between the resonators, the further apart the inner conductors of a pair of resonators are and the smaller the coupler opening in the panel between the inner conductors is.

A well-known simple form of bandpasses in coaxial milling technology became known, for example, from the EP 2 044 648 B1 or the EP 1 620 913 B1, whereby the latter example is a high-frequency switch.

As a result of the tolerances both in the production of the casting tool and in the actual casting or milling process, it is generally necessary to calibrate a coaxial high-frequency filter. This calibration can occur through twisting of the adjustment elements, whereby the resonance frequency can be changed and adjusted. Furthermore, with stricter requirements, it is often necessary to set the coupling using an adjustment element during filter calibration.

In order to make network planning easier for network operators, it is also possible to remotely set and adjust the resonance frequencies for the individual resonators, and thus the frequency position of the bandpass filter in operation electronically, for example, and to do so during ongoing operation. Reference should be made in particular to the EP 2 053 687 A1 and the EP 1 604 425 B1.

Furthermore, it should be noted that not only the frequency but also the coupler bandwidth and thus the bandwidth of the filter can be adjusted. It is therefore proposed, in accordance with DE 10 2004 055 707 B3, that one or more recesses are formed in the base of the housing between a part of the inner conductor conduits for the neighbouring resonators. This is based on the knowledge that this type of recess leads to a weakening in the electrical coupling between neighbouring resonators. The degree of coupling is thus determined by the lateral spread and the depth of the recess.

In accordance with DE 2 108 675, it is proposed that the partition between two neighbouring resonance cavities be formed of two parallel metal plates between which a metal shutter can be slid using a control device. At the same time the contact devices are to ensure a good contact between the metal shutter and the metal plates at any degree of opening of the window.

This prior publication thus ultimately shows the movement of a panel between two resonators in order to change the coupler bandwidth and, as a result, the filter bandwidth.

However, these known solutions require a high degree of mechanical effort. Linked to this, the resulting susceptibility to errors has proven to be detrimental. Finally, the solutions which had previously become known also show significant disadvantages with regard to passive intermodulation.

A tuneable filter frequency also became known from DE 1 222 600. Two coaxial resonators in which the coaxial interiors are connected to one another via a shared aperture opening are described. This tuneable filter arrangement, particularly suitable for very short electromagnetic waves,—consisting of the at least two coupled resonance conduction sections as mentioned—is designed so that the bandwidth of the filter is at least approximately constant across the tuning range. A fixed capacitive pin, comprising two pin elements driven into a metal connector and pressed together using two compression springs, and between which an immersing wedge depending on the corresponding adjustment is inserted, is intended for the coupling of successive resonance conduction sections.

Finally, we also refer to WO 2009/056813 A1. An adjustable filter with a coaxial design is described herein. Once again, it likewise comprises an inner conductor housed in a waveguide resonator housing and a tuning element screwed into the cover of this in axial elongation which can be screwed in by different distances on the front side of the inner conductor in the coaxial resonator housing. The operating frequency of the filter is thus adjusted.

Alongside the inner conductor acting as the first resonator, the design also includes a second rod-shaped inner resonator which is held by a rotatably mounted actuator and protrudes between the wall of the housing and the inner conductor into the interior of the coaxial resonator. Electromagnetic coupling is thus caused between the first and second resonators. Furthermore, the design calls for an adjustment element between the first and second resonators, both protruding into the interior of the coaxial resonator, which is held and mounted such that its position can be altered or it can be adjusted by sliding along a rod between the two resonators (for example, between the two resonators through angular adjustment on a swivel axis which runs horizontally or vertically to the axes of the first and second resonators). An arrangement in which the resonance frequency of the filter and/or the bandwidth of the filter can be modified is thus created.

An tuneable high-frequency filter with a coaxial design which shapes the category became known from the EP 2 544 297 A1. A filter with, for example, two resonators arranged next to each other in a coaxial design with circumferential housing walls and inner conductor resonators arranged centrally in the interior is described. Both resonators are coupled with one another via a coupler opening in the partition which separates the resonators. The usual transmission path in the filter is defined through this coupler window located in the partition.

In addition, the partition ends in front of a housing wall running transverse to it and forms an additional coupling space there which is comparable in size to the actual coupler opening (through which the transmission path for the filter runs). An inductive coupling link which has an elongated shape and which stretches through the coupling area is arranged in this coupling space. The one end of this coupling element ends in the one resonator, whereas the second opposite coupling end of this coupling element ends in the next resonator. In the middle section between the two ends, the coupling element has a lateral protrusion.

The coupling element is arranged at a parallel distance from the base area. To this end, it is held by a supporting structure which is simply attached to the one end of the coupling element. The opposite second end of the coupling element ends freely at a distance above the base of the resonator housing.

In addition, there is an adjustment element which, for example, ends above the coupling element and can be brought to a variety of positions. This adjustment element can be adjusted from a distance away from the coupling element towards the coupling element until it is arranged in the area of the lateral protrusion attached to the coupling element and remains free from contact with it. The high-frequency filter can be variably adjusted via the dielectric adjustment element which can be adjusted to or from this path on the fixed coupling element. By contrast, the purpose of this invention is to create an improved high-frequency filter, and in particular an improved duplex switch, predominantly for the mobile telephony sector, which is inherently simple in design and is as problem-free as possible with regard to intermodulation, and thus allows for better adjustment of the coupling bandwidth.

According to the invention, the solution stands out because the corresponding high-frequency filter—alongside the known measures where applicable, for example with the use of sliders for frequency adjustment—comprises additional means of adjustment, in particular in the form of calibration sliders which allow for adjustment of the coupler bandwidths.

As a result, a range of benefits can be achieved within the invention, namely:

- A relatively large range of adjustment is possible for changing the coupler bandwidths within the invention.
- Above all, the invention ensures that passive intermodulation is suppressed and that stable, clearly reproducible and thus defined conditions apply in the HF filter with constant electrical contacts.
- The high-frequency filter according to the invention stands out thanks to low production costs since the parts which are known and needed for adjusting the frequency of the individual resonators can equally be used for setting the coupler bandwidths in accordance with the invention.
- Ultimately, the invention also offers the option of arranging the individual resonators in two (or more) rows, for example, and therefore being able to move them both longitudinally and in the direction of mounting in relation to each other. This also results in particularly interesting and advantageous options for setting the coupler bandwidth.
- Finally, it is also possible to produce structures from multiple coaxial resonators which are arranged in at least two rows, wherein the corresponding adjustment elements are arranged running crosswise so that adjustments can be made to the means of adjustment, for example adjustment in a 90° direction offset from one another. As a result, even structures in a particularly favoured embodiment of the invention in which two angularly or in particular vertically arranged adjustment or sliding devices can be operated using just one means of adjustment are possible.

The invention is explained in more detail by means of design examples with reference to drawings below. The individual drawings show:

FIG. 1*a*: a schematic plan view of a three-channel cavity filter;

FIG. 1*b*: a side sectional view along the A-A' line in FIG. 1*a;*

FIG. 1*c*: a sectional view at 90° to FIG. 1*b* along the B-B' line in FIG. 1*a;*

Figure 2A:
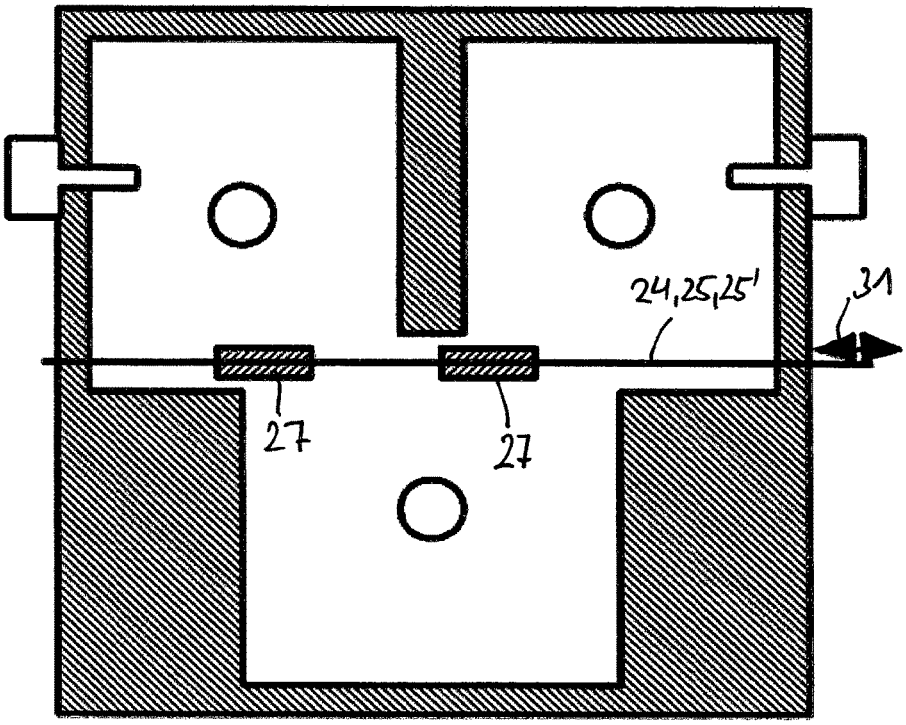
Figure 2B:
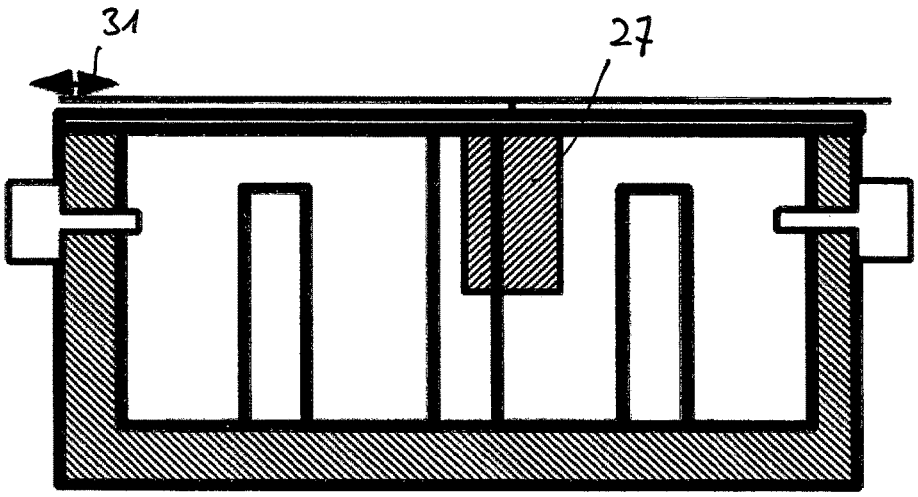
Figure 3A:
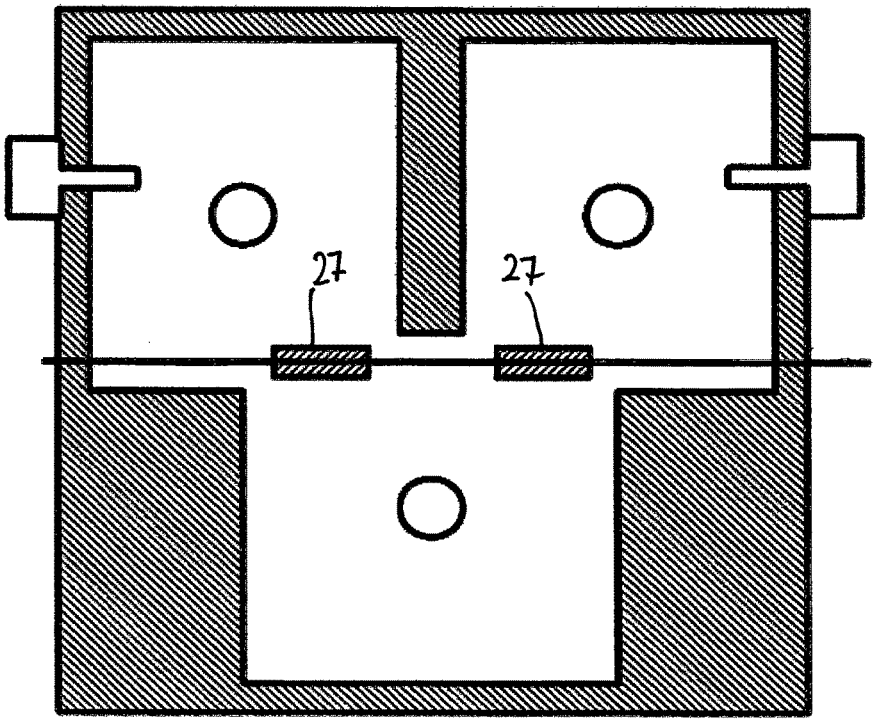
Figure 3B:
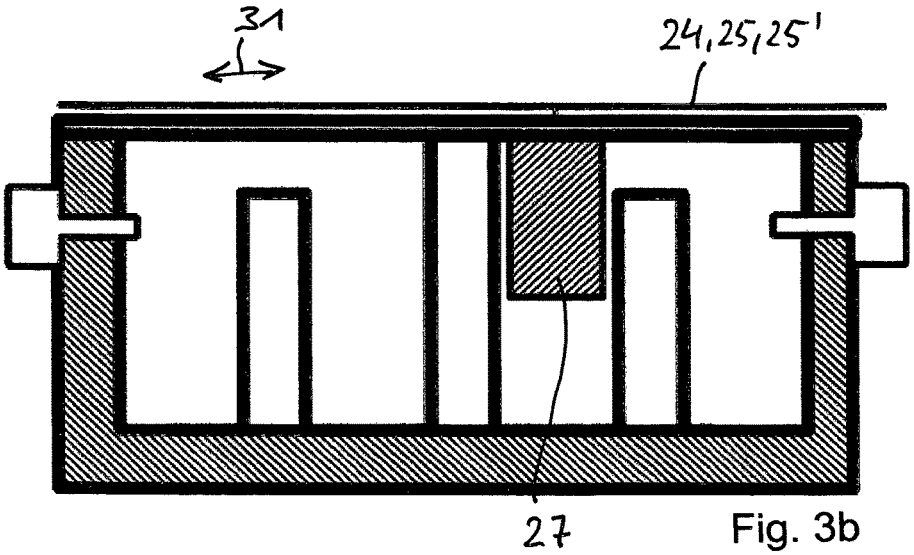
Figure 4:
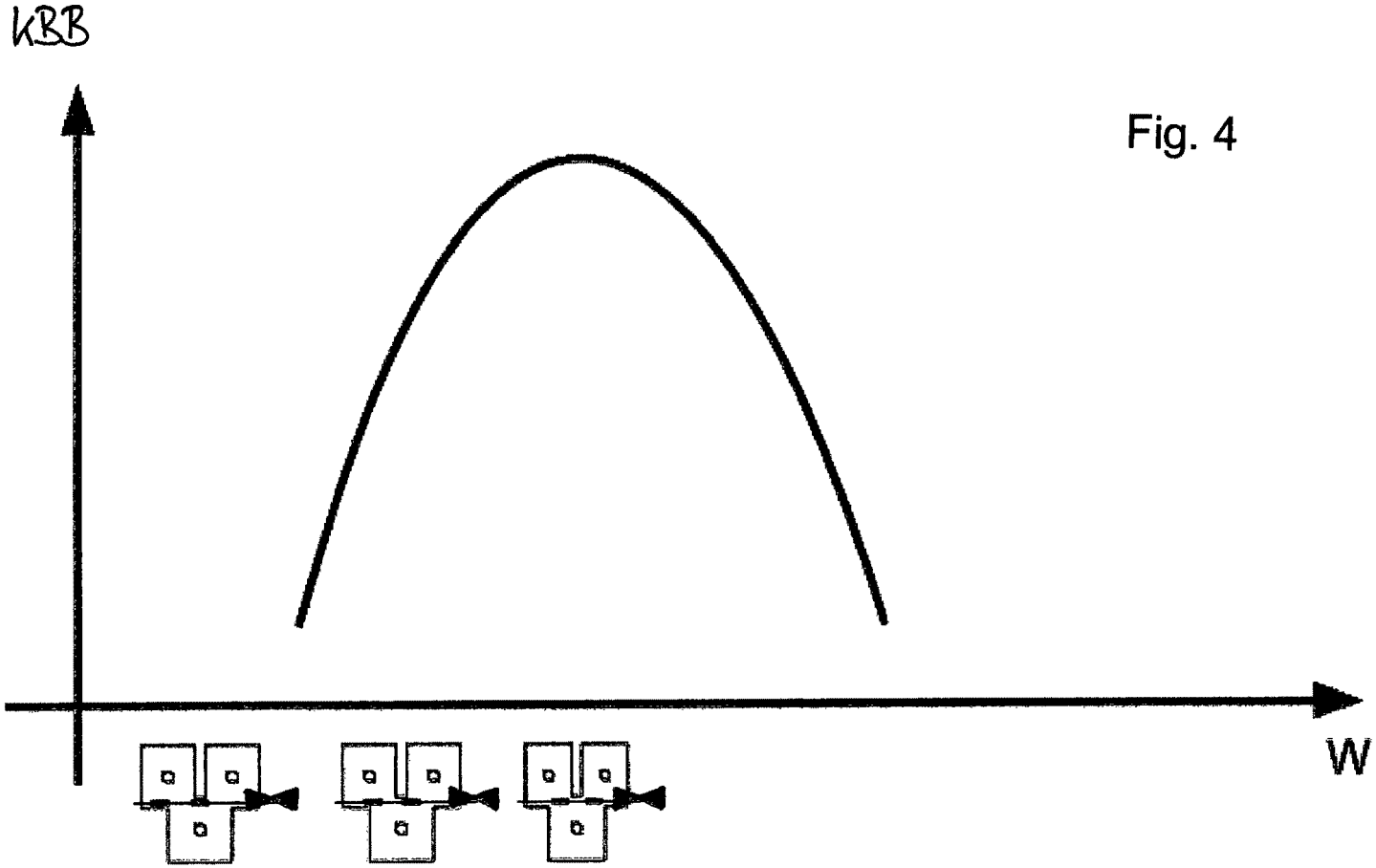
Figure 5:
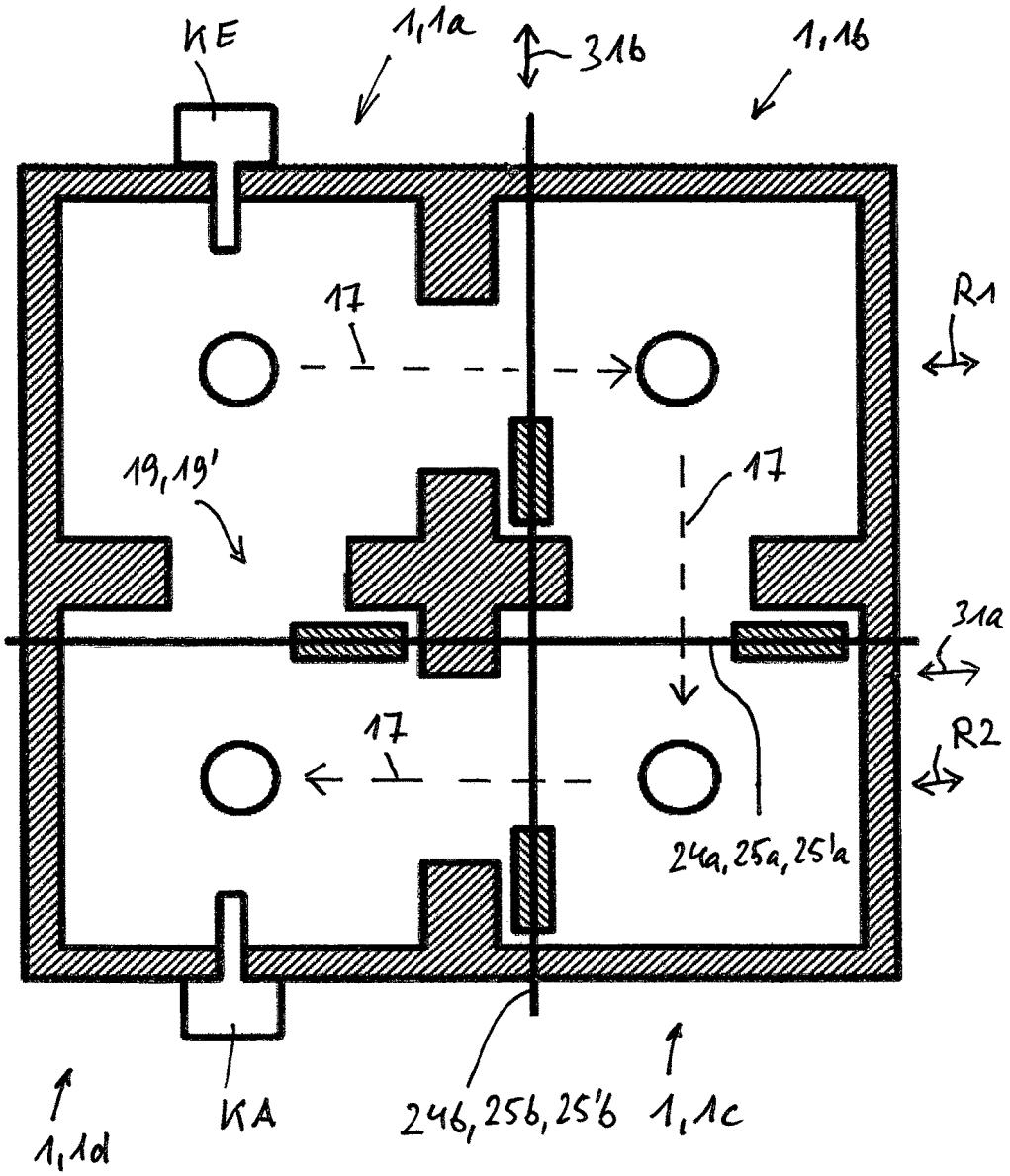

FIGS. 2*a* and 2*b*: corresponding representations to FIGS. 1*a* and 1*b*, but with different setting positions for the coupling elements;

FIGS. 3*a* and 3*b*: further representations as variations on FIGS. 1*a* and 1*b*, and 2*a* and 2*b* in which the coupling elements are again shown in a different setting position;

FIG. 4: a representation of the coupler bandwidth depending on the setting position for the coupling elements in an aperture opening area;

FIG. 5: a design example of a four-channel high-frequency filter which differs from FIG. 1*a;*

Figure 6:
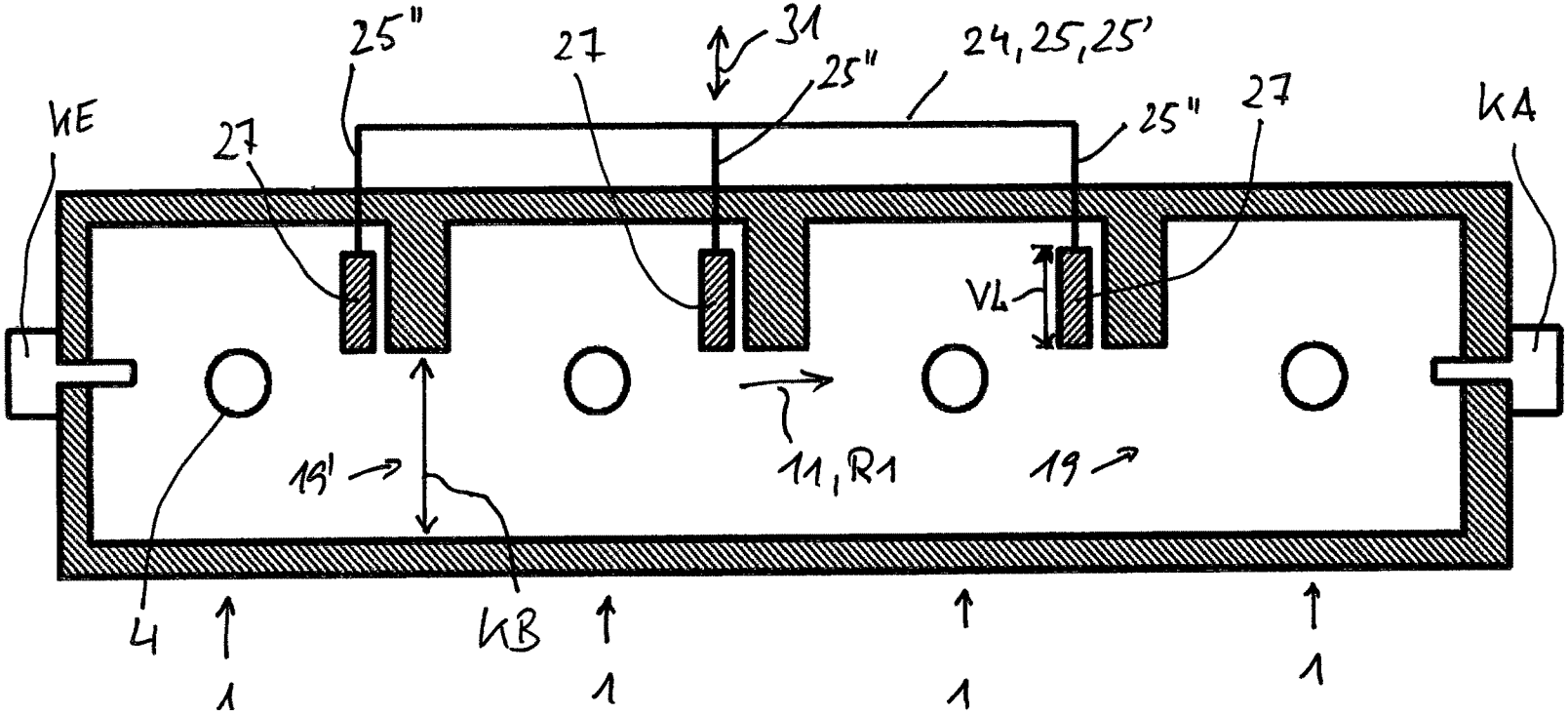
Figure 7A:
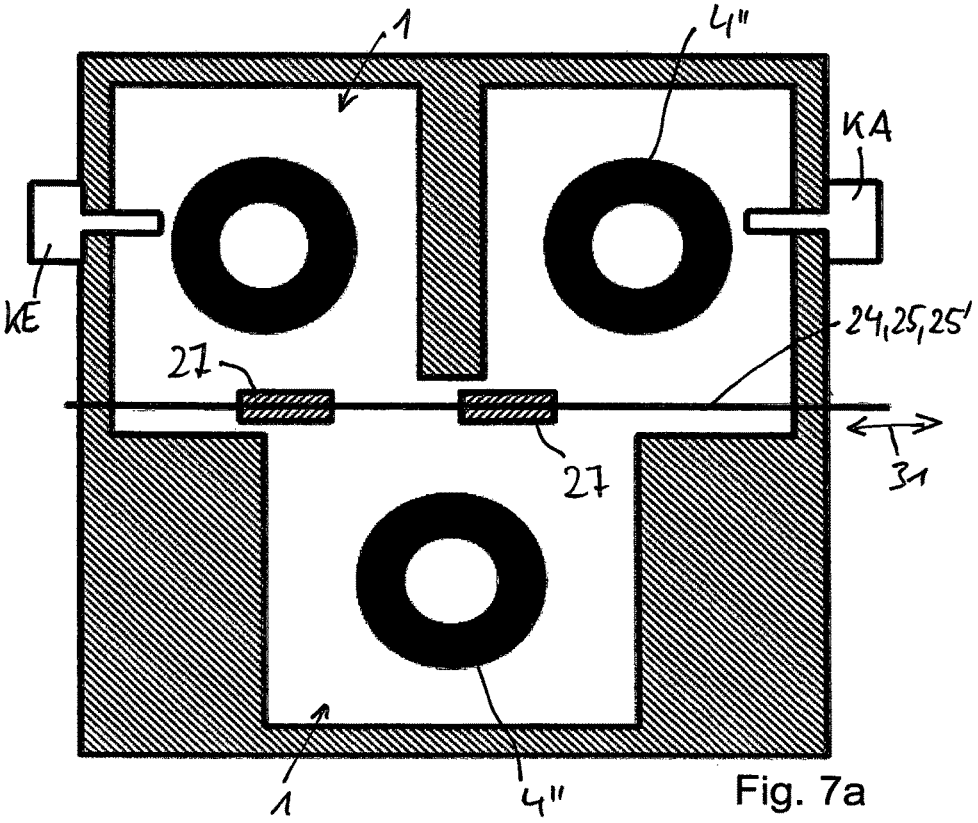
Figure 7B:
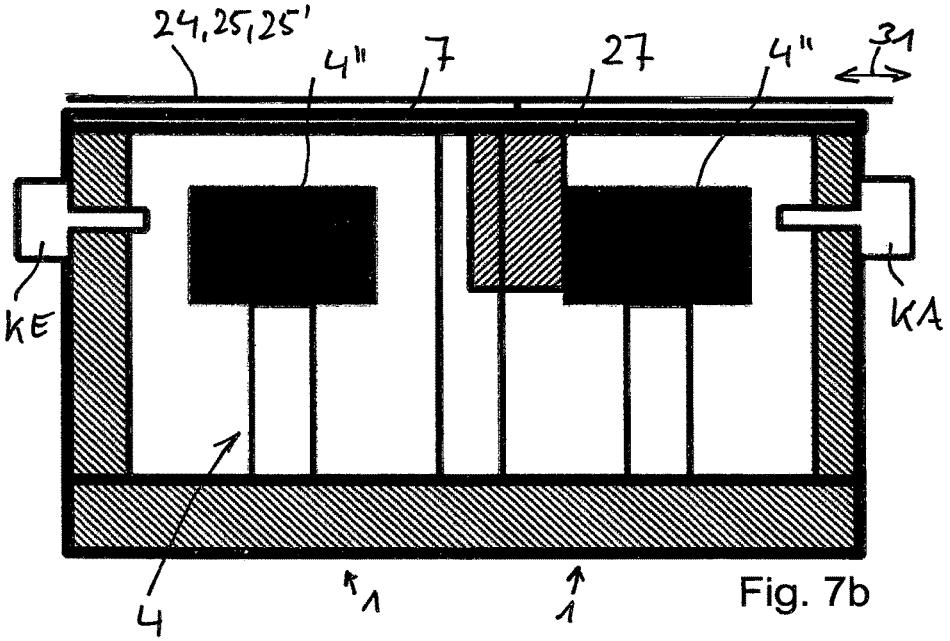

FIG. 6: another different design example in plan view, in which four individual cavity resonators are arranged behind one another in the direction of mounting, with an associated sliding device for adjusting the coupler bandwidth;

FIG. 7*a*: a design example which is slightly different from FIG. 1*a*, using a ceramic inner conductor;

FIG. 7*b*: a corresponding representation similar to FIG. 1*b*, but using a ceramic inner conductor as shown in FIG. 7*a;*

Figure 8A:
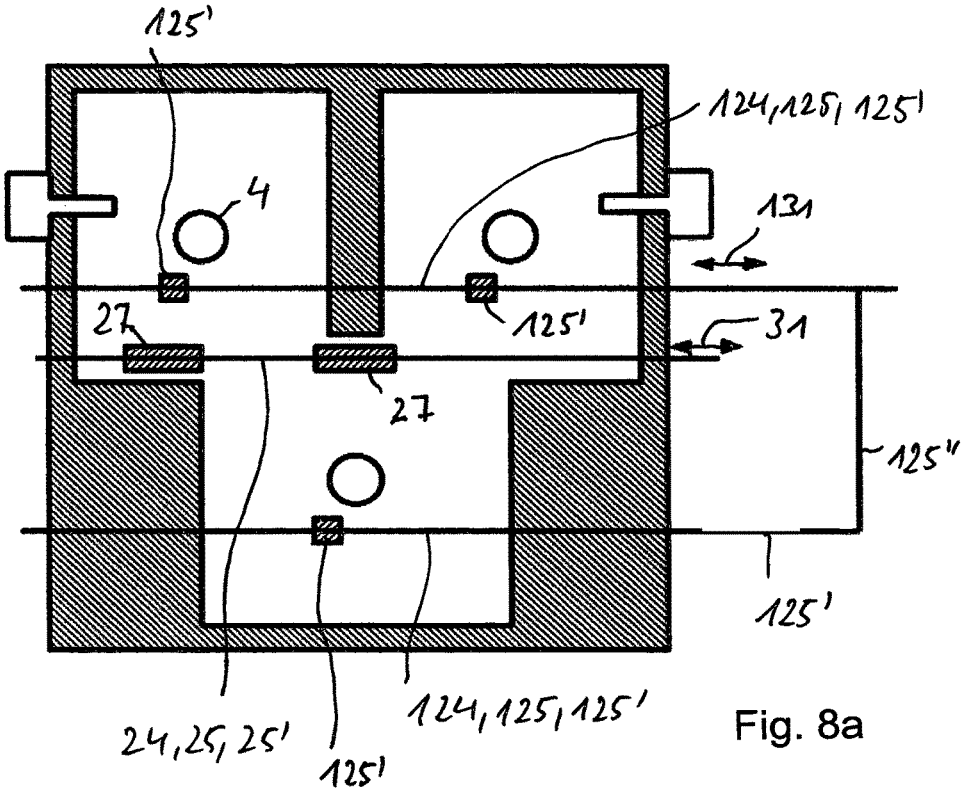
Figure 8B:
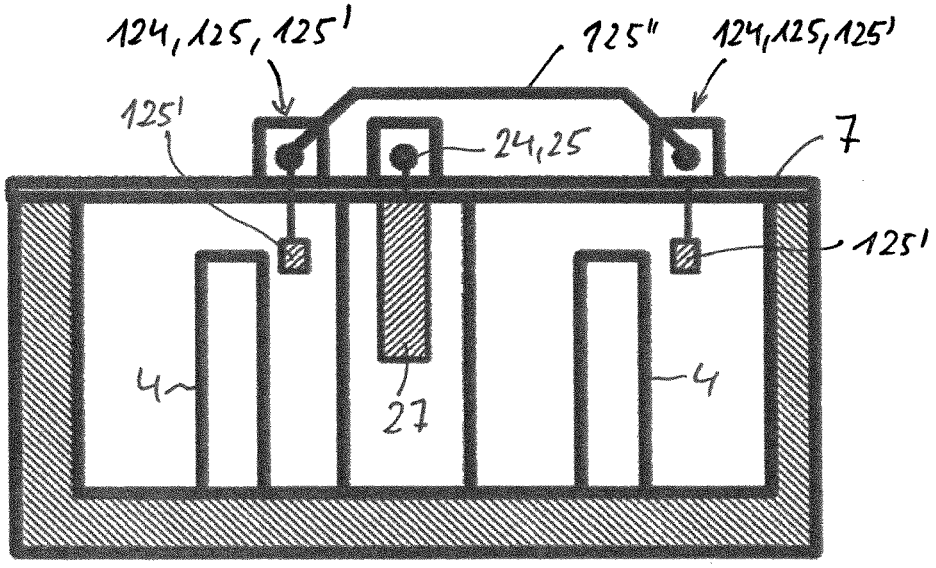

FIG. 8*a*: a design example matching FIG. 3*a* in a plan view through a cross-section through an HF filter which has an additional device for adjusting the frequency and in particular the resonance frequency along with a device for adjusting the coupler bandwidth;

FIG. 8*b*: a plan view of an axial sectional view vertical to the representation in accordance with FIG. 8*a;*

Figure 9:
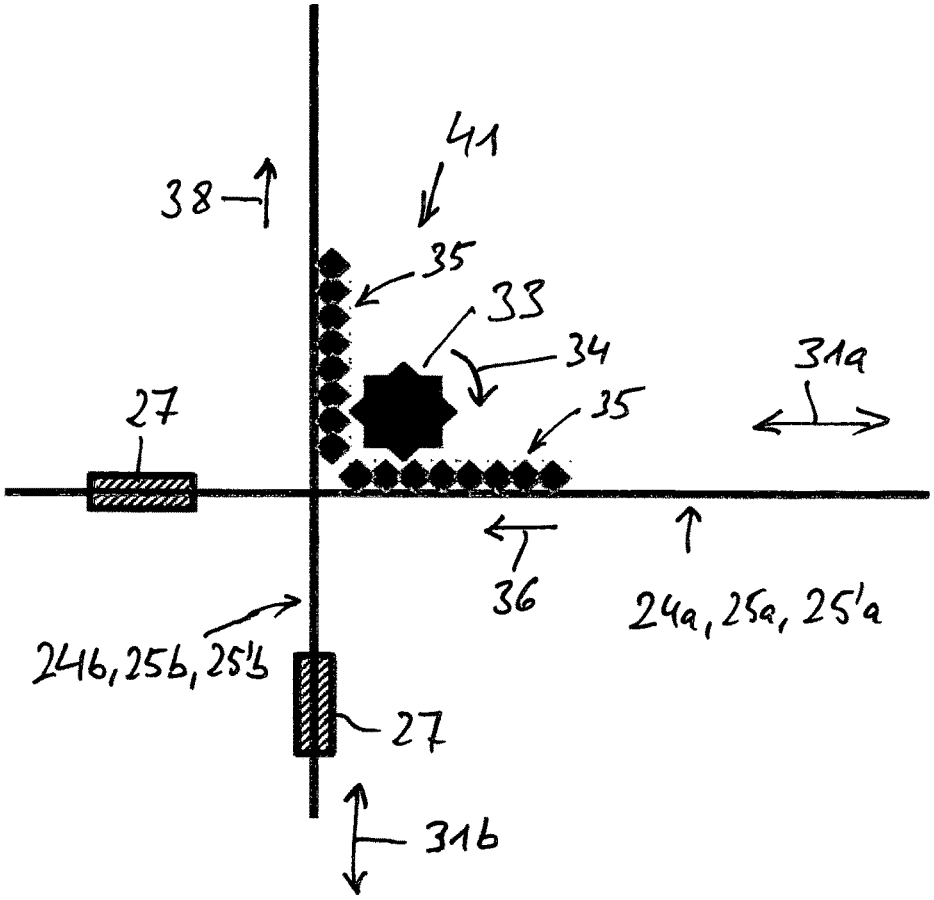
Figure 10A:
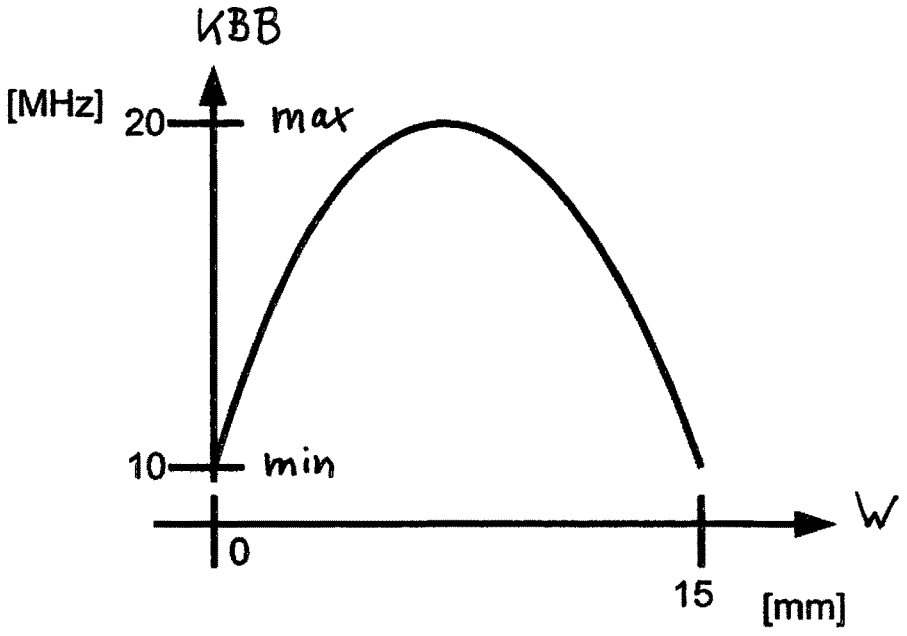
Figure 10B:
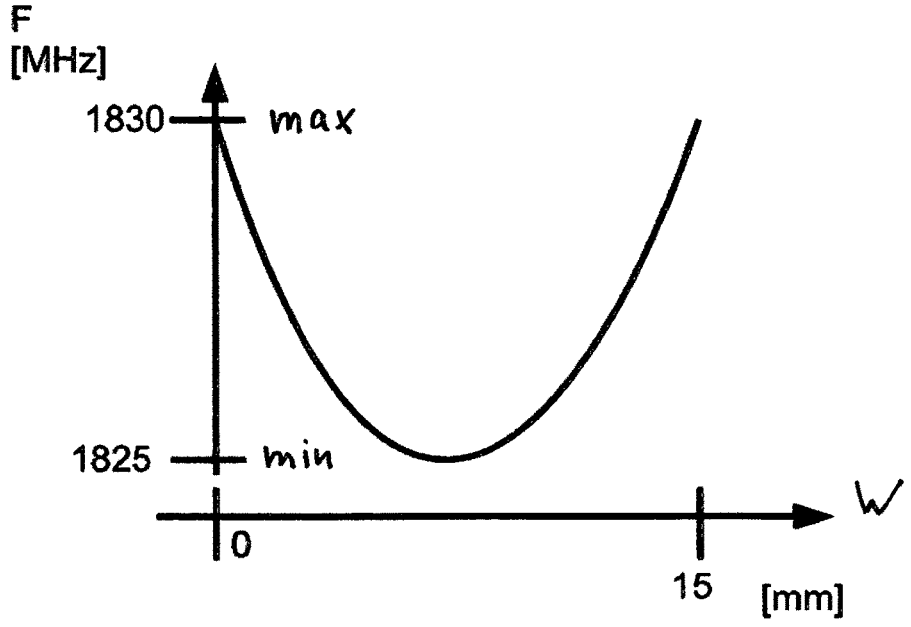

FIG. 9: an additional coupler device for simultaneous and synchronous adjustment of adjustment devices running transversely and in particular vertically to one another, particularly in the form of push rods for adjusting the coupler bandwidth;

FIG. 10*a*: a diagram for clarification of the maximum adjustment of the coupler bandwidth in a design example in accordance with the invention; and FIG. 10*b*: a diagram for clarification of the adjustment of the resonance frequency of the resonator as a function of the adjustment of the coupler bandwidth.

FIG. 1 shows a schematic, horizontal cross-section of a preferred version of a high-frequency filter, in particular a high-frequency bandpass filter, in accordance with the invention.

Thereby, the design example in accordance with the invention shows a three-channel microwave filter formed of co-axial TEM resonators in a schematic plan view (with the cover removed) in FIG. 1*a* and in a schematic, side axial sectional view in FIG. 1*b*. In other words, the design example shows three single-channel high-frequency filters 1 in a coaxial construction with three resonators. This also shows that the single-channel HF filters or single resonators 1 in a coaxial construction in principle consist of or comprise an electroconductive outer conductor 3, a concentric or coaxial inner conductor 4 arranged around it and a base 5, wherein the electroconductive outer conductor 3 and the electroconductive inner conductor 4 are electrically (galvanically) connected to one another.

The bandpass filter is overhead, therefore can be sealed with clearance from the free end 4' of the inner conductor 4 using a cover 7. Using specific adjustment mechanisms, for example through axial adjustment of the inner conductor or through axial adjustment of a tuning element 9—as indicated in FIG. 2 in the cover 7—which can be screwed in or out, particular settings can be made on a particular resonance frequency.

As shown hereinafter, the preference for this is to use a device in which the tuning elements 9 can be adjusted via a corresponding common adjustment element.

In the design example shown, the three coaxially designed high-frequency resonators 1 are shown either with a square base or a base 5. The appropriate cavity 15 in the high-frequency resonators 1 shown in the figures is thus bordered by metallic walls 8. The corners or corner areas formed between two generally vertically connected walls 8 can in practice more likely be designed rounded off, which has production benefits (in particular when the resonator cavity 15 is milled from a solid metal block). The generally circular cylindrical, metallic inner conductor, the length of which is a little below a quarter of the wavelength of the resonator frequency, usually ends a short distance, often just a few millimeters, below the cover.

In other words, the design example shows a high-frequency filter with an outer conductor housing 2, which comprises said housing base 5, housing walls or housing outer walls 8 and a housing cover 7, wherein the housing cover 7 is generally intended to be opposite the inner conductor end 4' (wherein the base can also be designed as the cover over the remaining housing in principle). The outer conductor housing 2 thus comprises multiple interior walls or partitions 29 which separate the individual resonators with their cavities 15 from one another.

The distinctive feature in the design example in accordance with FIG. 1*a* is that the three individual resonators 1 shown are positioned in two rows R1 and R2 next to each other. In this design example, only a single resonator 1 is planned in the second row R2. This single individual resonator 1 in the second row R2 is arranged centrally with reference to the distance A between the centre of the two individual resonators 1 planned for the first row R1. This means that the centre of the resonator 1 planned for the second row R2 is always half of distance A from the centre of the first and the second resonators in the first row R1 with reference to the axial direction 11.

In the design example shown, there are three individual resonators 1 located in the same housing 2, wherein the side walls 8 which enclose the cavity 15 and which normally separate the individual resonators 1 from each other have penetrations 19 at least in the transmission zone 17, namely so-called coupler openings 19' (coupler apertures 19') which are formed by the wall sections 21 of the side walls 8 which are bounded by the penetrations 19. The coupler openings 19' can thus also be limited by wall sections which protrude down from a cover 7, for example, or up from a housing base 5 by a specified amount.

In the design example shown, the transmission path 17 runs from an input point KE shown in FIG. 1*a* (in the form of a coaxial input point in the first individual resonator 1*a*, for example) through the coupler opening 19' to the next individual resonator 1*b* which is arranged in the second row R2. From there, the transmission path 17 runs back through the next coupler opening 19' to the third resonator 2*c* which is once again arranged in the first row R1. There, the decoupling point KA is then intended for decoupling the signal. If, for example, there was a fourth individual resonator 1 in the direction of mounting 11 in the second row R2 in the design, then the signal path 17 could run from the third individual resonator 1*c*, similarly to from the first to second individual resonator, to the fourth individual resonator. This type of transmission path, which runs in a zig-zag shape in this design example, is not required. However, the variant depicted allows for benefits which are discussed below.

Furthermore, an adjustment device 24 in the design example, which consists primarily of a sliding device 25 in the form of a push rod 25' or comprises the push rod 25' in the design example shown, in accordance with FIGS. 1*a* and 1*b* is intended for the various adjustments and changes to the coupler bandwidth.

Coupling elements 27, which may be arranged in the shape of a rectangle in the side rendering in accordance with FIG. 1*b*, without this design being required, for example, are attached to this sliding device 25 lengthways. The coupling element 27 thus has a comparably thinner thickness VD in relation to its length and height VL and VH.

The length VL of the coupling element 27 and the height VH of the coupling element 27 is generally smaller than the coupler window width KB and the coupler window height KH in each case, although this does not have to be the case. In other words, the coupler window height KH (and thus also the height VH of the coupling element 27) can have a value which is preferably larger than 5% of the overall chamber height, i.e. the distance between the upper side of the base 5 facing the cavity 16 and the underside of the housing cover 7. As a result, the coupler window height KH preferably has a value which is greater than 10%, and is in particular greater than 15%, 20%, 25%, 30%, 35%, 40%, 45%, 50%, 55%, 60%, 65%, 70%, 75%, 80%, 850 and in particular greater than 90% of the corresponding chamber height KH for the resonators 1. Conversely, the chamber height KH (and thus ultimately also the height VH of the coupling element 27) can also have values which are smaller than 95%, in particular smaller than 90%, 85%, 80%, 75%, 70%, 65%, 60%, 55%, 50%, 45%, 40%, 35%, 30%, 25%, 20%, 15% or in particular smaller than 10% of the chamber height KH.

At the same time, the coupling element 27 is rather fixed or hung overhead in the area of the subsequent adjustment device 24 and then ends according to its axial extension in the coupler height KH direction a corresponding distance above the base 5, as shown in the drawings. At the same time, the coupler window is generally designed so that a coupler wall stretches from the base 5 to part of the height of the resonator so that the remaining area then forms the coupler window height KH for the coupler aperture. In other words, there remains a gap to the base 5 with regard to the coupler opening 19' and the coupling element 27.

The corresponding length VL of a particular coupling element 27 can likewise differ to a large extent. The preferred values are between 10% and 80% of the coupler width KB for the particular coupler opening 19', i.e. the width KB of a particular opening 19. The length VL of the particular coupling element 27 can thus then have values which are larger than 10%, 15%, 20%, 25%, 30%, 35%, 40&, 45%, 50%, 55%, 60%, 65%, 70%, 75% of the width KB of a coupler opening 19' on the one hand and are preferably smaller than 80%, 75%, 70%, 65%, 60%, 55%, 50%, 45%, 40%, 35%, 30%, 25%, 20%, 15% of the width KB of a coupler opening 19' on the other hand.

The thickness VD of a particular coupling element 27 can vary to a large extent. In other words, the thickness of a coupling element 27 transversely to its direction of adjustment can also comparatively be designed to be very thin. The important thing is simply that the thickness is chosen to be sufficiently great that sufficient strength, stiffness, stability, etc. can be achieved.

Finally, it should also be noted that the coupling element 27, which is used to set the coupler bandwidth, can be made from metal and/or dielectric, or can at least comprise a metallic coating or a metallic core etc. alongside dielectric layers.

The plan view in accordance with FIG. 1*a* indicates that the sliding device can be put into a position by sliding the push rod 25' in which both coupling elements 27 take up a position in which the two coupler openings 19' from the first to the second resonators 1*a*, 1*b* and from the second to the third resonators 1*b*, 1*c* are more or less open and free. As the first coupling element 27*a* shown in FIG. 1 is located lateral to a housing wall, i.e. a housing wall section 21 in the cavity 15 of the first resonator 1*a*, whereas the second coupling element 27*b* is positioned directly in front of the vertical boundary surface 29' of the partition 29 between the first and third resonators 1*a*, 1*c* of the resonators arranged in the first row R1.

Now, an appropriate setting can be made in accordance with the double arrow image 31 using the adjustment device 24 in the form of the sliding device 25 (push rod 25').

FIG. 2*a* in plan view and FIG. 2*b* in side view show that the adjustment device has been set to a certain path length along the push rod 25' so that the two coupler openings 19' are now more or less half covered, which relates to the free width of the coupler opening 19' at least in plan view.

For the representations in accordance with FIGS. 3*a* and 3*b*, the push rod 25' has once again been set to an appropriate path length, namely far enough that the corresponding coupling elements 27 are now positioned more or less centrally in the two coupler openings 29. From this it can also be seen that even in this position, there is definitely a large part of the coupler opening 19' which is not covered by the coupling element 27 as there remains a correspondingly large gap between the underside 27' (i.e. the bottom edge 27') of the rather plate-shaped coupling elements 27 and the surface of base 5, so that the coupler window 19' is always uncovered here.

In FIG. 4, the coupler bandwidth KBB is shown in relation to the adjustment track W for the adjustment device 24, i.e. the sliding device 25 with the push rod 25', and thus in relation to the coupling elements 27. Here the respective adjustment positions for the coupling elements 27 are shown above the track W in a miniature depiction, as have been shown and described by means of FIG. 1*a*, FIG. 2*a* and FIG. 3*a*.

FIG. 5 shows a modified design example in a schematic plan view with a four-channel microwave filter in which the two resonators 1*a* and 1*b* are arranged in the first row R1 and the two resonators 1*c* and 1*d* are arranged in the second row R2. In this design example, the resonators in the first and second rows R1, R2 are not arranged placed at half the distance between the centres of the two neighbouring resonators, but in rectangular alignment to them in the axial direction 11 and the vertical transverse direction 12.

This design example is intended for a signal path from input KE to output KA, namely along a C or U shaped transmission path 17 in plan view from resonator 1*a* through resonators 1*b* and 1*c* to the output resonator 1*d*.

In this design example, however, there is another planned opening 19, i.e. a coupler opening 19' between the first and fourth coaxial resonators 1*a*, 1*d* even though the actual transmission path occurs through resonators 1*a*, 1*b*, 1*c* to resonator 1*d*. This achieves and allows for an additional coupling between non-adjacent circuits or resonators. In other words, cross-coupling between non-adjacent resonators, i.e. resonators which are not adjacent with respect to the transmission path 17, is thus possible.

In this design example, a first adjustment device 24*a* with a sliding device 25*a* with a push rod 25'*a* with associated coupling elements 27 is planned, which can be slid at a variety of distances into the coupler opening between the individual resonators 1*b*, 1*c* in accordance with the double arrow image 31*a*—as in the previous design example—in order to adjust the desired coupler bandwidth or set it differently.

Furthermore, a differently adjustable second adjustment device 24*b* with associated sliding device 25*b*, running vertically to the first, is planned, likewise using a push rod 25'*b*, wherein the coupling elements 27 held here by the second push rod 25'*b* can be slid in or out of the coupler opening 19' between the first and second individual resonators 1*a*, 1*b* and between the third and fourth individual resonators 1*c*, 1*d* at a variety of distances, namely in accordance with the double arrow image 31*b*.

This design form also shows that the coupling elements 27 can be slid in or out of any coupler opening 19' at a variety of distances, for example, using two of more sliding devices 25 arranged vertically to one another, regardless of whether this coupler opening 19' connects two resonators in the same row R1 or two adjacent individual resonators which are positioned next to one another in rows R1 and R2.

In the design example in accordance with FIG. 5, too, further individual resonators 1 can be included in row R1 as well as in row R2, resulting in a longer transmission path 17 across accordingly more individual resonators. Here it is also possible to establish a meandering transmission path.

FIG. 6 shows a schematic side view of a modified design example in which multiple individual resonators—here four individual resonators 1—are arranged subsequently in an axial direction 11, i.e. in a single row R1.

Here too, the coupler openings 19' are each planned between two successive resonators 1 in side view placed congruently one after another, wherein in this design example only side walls 8 with their wall sections 21 arranged perpendicular to a housing wall 8 remain as coupler apertures 21.

Alongside these coupler wall sections 21, the corresponding coupling elements 27 which can all be moved using a common sliding device 25 are shown in the design example in accordance with FIG. 6.

These adjustment and sliding devices 24, 25 can then be set in accordance with the double arrow image 31 so that the coupling elements 27 can be set at a variety of distances into the respective coupler openings 19'.

The adjustment and sliding devices 24, 25 therefore here also comprise push rods 25' which are connected to a crossbar 25" running perpendicular to them in order to adjust the individual push rods 25', which are arranged in parallel with one another, together.

In contrast to the previous design examples, the sliding device 25 is here not adjusted lengthways, i.e. in an axial direction, to the individual rows R1 (or R2), but transversely to them. Nevertheless, the coupling elements 27 with their coupler element level KE running parallel with the inner conductor 4 (which thus runs parallel to the rectangular broadsides of the coupling element 27) are still arranged running more of less parallel to the coupler openings 19' in this design example as well. As a result, in plan view, the length of the wall sections 21, by which the width of the corresponding coupler opening 19' is limited, has a length L which is large enough that the coupling elements 27 shown in FIG. 6 are located to the side next to the side wall section 22 when the respective coupler opening 19' is fully open. However, the representation in accordance with FIG. 6 also shows that the length VL of the corresponding coupling element 27 can be shorter than the opening width KB or a coupler opening. This type of construction also allows for the realisation of the same benefits according to the invention, as has already been explained by means of the previous design examples.

Reference will also be subsequently made to FIGS. 7*a* and 7*b* in which a modified design example using ceramic resonance cavity filters is again shown. For this, an inner conductor end piece 4" made from ceramic which has or can have a hollow cylinder shape is placed on each free end of the inner conductor 4. However, the adjustment device 25 for adjusting a variety of coupler bandwidths otherwise fundamentally corresponds to the structure which has been explained by means of FIGS. 1*a* and 1*b*. This ceramic design can also be implemented accordingly in the other design examples.

In this case, the exterior diameter of the inner conductor end piece 4" placed (which is made from ceramic or comprises ceramic) shows an exterior diameter which, for example, can be significantly larger than the exterior diameter of the actual inner conductor 4 under it. In other words, the inner conductor end piece 4" can have an exterior diameter which is more than 10%, 20%, 30%, . . . , 120%, 130%, 140% or more than 150% larger than the diameter of the inner conductor under it. The inner conductor end piece 4" is designed in an axial length or axially running height which is preferably between 10% and 50% of the total height of the inner conductor 4, preferably making up between 10% and 30% of the total height of the inner conductor.

The representation in accordance with FIGS. 8*a* and 8*b* reflects a representation of a high-frequency filter in accordance with FIGS. 1*a* and 1*c*. Supplemental to the design example in accordance with FIGS. 3*a* and 3*b*, there is also an adjustment device for adjusting and modifying the resonance frequency included in the variant in accordance with FIGS. 8*a* and 8*b*.

This adjustment device 124 likewise comprises a sliding device 125 with a push rod 125', on which an adjustment element 125' which effectively hangs down into the corresponding cavity 15 is planned, likewise made from dielectric material or metal or a combination thereof, etc., for example. The relevant adjustment element 125' can be moved closer to the inner conductor 4 or further away from the inner conductor 4 through adjustment in accordance with the arrow image 131, thus allowing the resonance frequency to be adjusted.

In this respect, reference is made to known solutions in which corresponding adjustment elements can also be introduced, slid in, swivelled, etc. or not into the space between the front 4' of the inner conductor 4 and the cover underside of a housing cover 7 at a variety of distances in order to set the resonance frequency differently.

In the variant in accordance with FIGS. 8*a* and 8*b*, there are two push rods intended for this purpose, i.e. two means of adjustment 125' which run parallel to one another and each comprise an associated means of adjustment 125' which can be brought into the vicinity of the associated inner conductor 4 for the particular resonator 1. Both adjustment or push rods 125' are connected to one another via a corresponding transverse connection or a rod connector 125" and can thus be managed, i.e. adjusted or slid, uniformly.

Thus in these design forms, the coupler bandwidth KKB can be adjusted through operation of the adjustment device 24 with the sliding device 25 and the push rod 25' and the resonance frequency can be adjusted through adjustment of the additional adjustment device 124.

FIG. 9, for example, shows a supplement to the design example in accordance with FIG. 5 (without limitation thereupon) in which the two transverse and in particular vertically aligned adjustment devices 24*a*, 24*b* can be operated together, i.e. synchronously, with the associated sliding devices 25*a*, 25*b*, for example in the form of corresponding push rods and by means of a coupler device 41. For this, solely manually or motor driven drive wheel 33, for example, such as a toothed wheel or toothed wheel-like drive wheel 33 is provided which can be turned using a rotation axle running vertically to the drawing plane in the representation in accordance with FIG. 9, i.e. parallel to the axial direction for the inner conductor 4 and in the design example in accordance with FIG. 5.

Immediately next to the corresponding teeth on the toothed wheel 33 are then teeth or tooth-like formations 35, i.e. toothed rack-like formations for example, which can be engaged with the teeth of the toothed wheel 33, to which the two transversely and in particular vertically running adjustment devices 24*a*, 24*b* are connected or attached. In the event of a rotation of the toothed wheel 33 clockwise, for example, in accordance with arrow 34 in FIG. 9, the adjustment device or push rod 24*a*, 25*a*, 25'*a* with the attached coupling elements 27 is then correspondingly adjusted to the left in accordance with the arrow display 36 and the adjustment device 24*b*, vertical to it, with the sliding device 25*b* and the push rod 25'*b* is adjusted in accordance with the arrow display 38. For rotational movement of the drive wheel 33 in the opposite direction, the two adjustment devices 24*a* and 24*b* can be adjusted in the opposite adjustment direction against the arrows 36, 38. If a high-frequency filter comprises more than four individual resonators which are arranged in two or more rows then multiple of this type of push rod-like adjustment devices can be included, running partially parallel and partially vertical to one another. All of these adjustment devices and push rods can then be coupled using appropriate coupling devices 41 so that all adjustment devices and push rods can be adjusted together and synchronously, for example by driving one of these preferred toothed wheel-like coupling wheels 33. In the same way, just one of the multiple push rod-like adjustment devices 24 can be adjusted manually or using a motor so that all other adjustment devices 24 thus coupled through this coupling device 41 are set together, in particular using the push rods 25' as explained.

FIG. 10*a* shows schematically how, for example, a coupler bandwidth can be set between the extreme settings shown based on FIGS. 1*a* and 3*a* through appropriate operation of the sliding device 25. In this way, for example, a minimum (min) coupler bandwidth of 10 MHz can be changed to roughly 20 MHz (for example as the maximum (max) bandwidth). However, this is just an abstract example. If you adjust the sliding device back to the opposite extreme setting (so that, for example, the coupling element 27 located in front of the central partition 29 in FIG. 1*a* is adjusted to a right extreme setting next to the right-hand side wall 8) then you adjust the coupler bandwidth back from the maximum value (max) of 20 MHz for example to the minimum value for the coupler bandwidth KBB, for example in the region of 10 MHz. This also shows that an adjustment just between the minimum and maximum values is sufficient since an additional adjustment beyond the maximum value of the coupler bandwidth in the other extreme position is fundamentally not required. In other words, an adjustment track W between the positions in accordance with FIG. 1*a* and FIG. 3*a* is sufficient.

At the same time, the resonance frequency of the corresponding resonator would have been changed, namely from a maximum frequency F of 830 MHz, for example, to a minimum frequency of 825 MHz, for example. If you were to adjust the coupling element 27 beyond the central neutral position to an opposite extreme setting (as previously explained), then the maximum resonance frequency F of 830 MHz, for example, would be reached.

Using the additional sliding device 125 discussed by means of FIGS. 8*a* and 8*b* for adjusting the resonance frequency, the adjustment device 124, 125, 125' can be adjusted in a way that the resonance frequency can be set to other values. It would thus be possible to apply such a form of offset so that the resonance frequency does not change at all regardless of the adjustment of the coupler bandwidth. By way of derogation from the representation in accordance with FIG. 10*b*, it is also possible to execute an overcompensation such that, for example, the corresponding resonance frequency is even higher, i.e. has become larger, upon adjustment of the coupling element 27 to achieve a maximum coupler bandwidth. In this respect, there are likewise no limitations.

It is made clear through the explanation of the design examples that a high-frequency filter which allows for adjustment of the bandwidth through simple means can be realised. At the same time, it is also possible to implement an adjustment device for adjusting the frequency and in particular the resonance frequency as explained in particular by means of FIGS. 8*a* and 8*b*. The overall design is extremely compact as a result. The solution therefore also allows for a very flexible filter concept since the individual HF resonators, i.e. the coaxial HF resonators 1, can be arranged sequentially in any order, for example in one, two or multiple rows. The transmission path 17 can thus occur on any path, including meandering from one individual resonator to the next. In this respect, there are no limitations.

As a result, it is not excluded in the context of the invention that cross-coupling between electrically non-adjacent resonators (with reference to transmission path 17) can be realised, as also explained based on FIG. 5.

By way of derogation from the design example in accordance with FIGS. 3*a* and 3*b*, for example, the partitions 29 (which separate two individual resonators located adjacent to one another in a row R1 or R2) can thus also protrude so far towards a resonator located in a second row R2 parallel to it that said partitions 29 effectively protrude by a partial length into cavity 15 of the resonator located in a parallel row. When considered from the front, the individual partitions 29 arranged spaced in direction of mounting or in the direction of row R1 or R2 effectively overlap, i.e. overlap on their free ending areas.

The invention claimed is:

1. High-frequency filter in a coaxial design comprising:

an outer conductor housing with a housing base and a housing wall, multiple resonators formed in the outer conductor housing, the resonators each comprising an inner conductor electrically coupled with the housing base which is designed in an associated cavity in the outer conductor housing which is delineated by the housing or side walls, a transmission path running through the high-frequency filter, wherein each two adjacent resonators are connected with one another via at least one coupler opening having a width KB and a height KH, an adjustment or sliding device for adjusting the coupler bandwidth, the adjustment or sliding device comprising at least one adjuster to which at least one coupling element is attached, the coupling element being associated with one of the at least one coupler openings which lie along the transmission path, the coupling element being related to an associated coupler opening arranged in the resonator such that the adjuster and thus the coupling element is adjustable between two extreme settings through adjustment of the adjustment or sliding device in which the coupling element is fully or partially slid into the coupler opening lying along the transmission path or fully or partially slid out of said coupler opening or is moved or positioned away from this coupler opening, the coupling elements having a tile or plate-shaped design, the level of the coupling element running parallel or at least approximately parallel to the at least one associated coupler opening, and in the one extreme setting for the coupling element in which the coupling element is fully or partially slid out of the coupler opening, the coupling element is located next to a housing or side wall or a housing wall section in the cavity or a boundary surface of a partition between two resonators, wherein the coupling element has a length VL in an adjustment direction and a height VH running transverse to the adjustment direction, wherein the length VL is smaller than the coupler opening width KB and the height VH is smaller than the coupler opening height KH.

2. High-frequency filter in accordance with claim 1, wherein the adjustment device is arranged in the form of a push rod above the inner conductor end and the coupling elements are attached to it in a suspended orientation.

3. High-frequency filter in accordance with claim 1, wherein the coupling element or coupling elements are made from metal or a dielectric material or comprise metal or a dielectric material.

4. High-frequency filter in accordance with claim 1, wherein the length of the coupling element has values which are larger than 10% of the width of the at least one coupler opening and/or smaller than 80% of the width of the at least one coupler opening.

5. High-frequency filter in accordance with claim 1, wherein the height of the coupling element and/or the height of the coupler opening has a value which is greater than 5%, of the chamber height of a resonator.

6. High-frequency filter in accordance with claim 1, wherein the height of the coupling element and/or the height of the coupler opening has a value which is smaller than 95% in relation to the chamber height of a resonator.

7. High-frequency filter in accordance with claim 1, further comprising multiple adjustment devices using push rods which are arranged running parallel and/or vertically to one another.

8. High-frequency filter in accordance with claim 1, further comprising multiple push rods running parallel to one another which are structured to be operated together and are connected to one another for this purpose, via one or more cross connections.

9. High-frequency filter in accordance with claim 1, wherein the resonators comprise ceramic inner conductors or ceramic inner conductor sections.

10. High-frequency filter in accordance with claim 1, wherein the adjustment device comprises a sliding device, using a push rod, for making a variety of adjustments to the frequency of a resonator in addition to the adjustment device for adjusting the coupler bandwidth.

11. The high-frequency filter of claim 1 wherein the adjustment or sliding device is structured to move the at least one coupling element into the coupling opening and out of the coupling opening to be positioned next to a sidewall or housing wall within the outer conductor housing.

12. High-frequency filter in accordance with claim 1, wherein the adjuster comprises a sliding device which comprises a push rod to which at least one coupling element is attached.

13. High-frequency filter in accordance with claim 12, wherein multiple coupling elements offset from one another and placed longitudinally along the push rod are designed so that the multiple coupling elements can be adjusted in or out of their associated coupler openings at the same time.

14. High-frequency filter in accordance with claim 13, wherein the coupling elements have an n-polygonal shape in the side view, and are in particular rectangular or approximately rectangular.

15. High-frequency filter in accordance with claim 1, wherein multiple resonators are arranged in at least two rows running parallel to one another, wherein the resonators in one row are offset by a half distance in comparison with the resonators in the other row, wherein the distance is the spacing between the centres of two adjacent inner conductors, and that the coupler openings are also each planned between two adjacent resonators of which one resonator is arranged in one row and the other resonator is in the other row, wherein a section of the transmission path, which has a zig-zag shaped or meandering form, is formed by the coupler openings planned between the resonators in the first and second rows.

16. High-frequency filter in accordance with claim 15, wherein the push rod is arranged running through the transmission area for the resonators in the first row to the resonators in the second row and can move longitudinally.

17. High-frequency filter in accordance with claim 1, wherein at least two adjustment devices and/or push rods arranged transversely and vertically to one another are coupled via one or more coupling devices such that the corresponding adjustment devices and/or the push rods are movable together and/or synchronously.

18. High-frequency filter in accordance with claim 17, wherein the coupling device comprises at least one drive wheel in the form of a toothed wheel, which is engaged with toothed wheel-like engaging elements which are formed at the associated adjustment devices and/or the push rods.

19. A high-frequency RF filter comprising:

an outer conductor housing comprising a housing base and a housing or side wall defining cavities, the outer conductor housing providing therein first, second and third resonators each comprising an inner conductor electrically coupled with the housing base and disposed in an associated one of the cavities defined by the housing or side wall, at least one coupler opening disposed between the first and second resonators and between the second and third resonators, the at least one coupler opening coupling the first and second resonators with one another and coupling the second and third resonators with one another, an adjustment or sliding device for adjusting bandwidth, the adjustment or sliding device comprising a common adjuster to which at least first and second plate-shaped or tile-shaped coupling elements are attached, the level of the first and second coupling elements running at least approximately parallel to the at least one coupler opening, the coupling elements located next to a housing or side wall or a housing wall section in the cavity or a boundary surface of a partition between the first and third resonators, the common adjuster and thus the coupling elements being configured to be adjustable between first and second settings through adjustment of the adjustment or sliding device to thereby slide the coupling elements into and out of the at least one coupler opening and thereby adjust electromagnetic coupling between the first and second resonators and between the second and third resonators, wherein in the first setting the coupling elements are at least partially slid out of the at least one coupler opening.

20. The high-frequency filter of claim 19 wherein the coupling elements are smaller than the at least one coupling opening and in at least one position of the common adjuster are disposed entirely within both the at least one coupling opening and the outer conductor housing.

* * * * *